US007051907B2

(12) United States Patent
Brincat

(10) Patent No.: US 7,051,907 B2
(45) Date of Patent: May 30, 2006

(54) REFILLABLE BOTTLE AND SYSTEM OF REUSE

(76) Inventor: Kennth Brincat, 926 S. Bedford St., Los Angeles, CA (US) 90035

( * ) Notice: Subject to any disclaimer, the term of this patent is extended or adjusted under 35 U.S.C. 154(b) by 0 days.

(21) Appl. No.: 11/174,066

(22) Filed: Jul. 1, 2005

(65) Prior Publication Data

US 2005/0242121 A1 Nov. 3, 2005

Related U.S. Application Data

(63) Continuation of application No. 10/082,623, filed on Feb. 22, 2002, now Pat. No. 6,938,805.

(60) Provisional application No. 60/275,794, filed on Mar. 14, 2001.

(51) Int. Cl.
*B65D 25/40* (2006.01)

(52) U.S. Cl. ..... 222/568; 222/562; 222/545; 222/212

(58) Field of Classification Search ..... 222/568, 222/562, 545, 383.1, 206–215, 105, 142.7, 222/136, 129; 220/255, 259.1, 288, 256.1, 220/259.3; 40/301–313; 141/18, 22, 25, 141/113–114, 392; 239/304, 309
See application file for complete search history.

(56) References Cited

U.S. PATENT DOCUMENTS

| | | | | |
|---|---|---|---|---|
| 33,539 | A | | 10/1861 | Neff |
| 3,517,450 | A | | 6/1970 | Greco |
| 3,592,365 | A | | 7/1971 | Schwartzman |
| 3,990,611 | A | | 11/1976 | Sojka |
| 4,077,547 | A | | 3/1978 | Donoghue |
| 4,088,246 | A | | 5/1978 | Klingaman |
| 4,108,324 | A | | 8/1978 | Krishnakumar et al. |
| 4,351,740 | A | | 9/1982 | Joshi et al. |
| 4,448,316 | A | | 5/1984 | Hiroshige |
| 4,567,926 | A | | 2/1986 | Lichfield et al. |
| 4,623,076 | A | | 11/1986 | Karpal |
| 4,705,191 | A | | 11/1987 | Itzel et al. |
| 4,725,464 | A | | 2/1988 | Collette |
| 4,781,311 | A | | 11/1988 | Dunning et al. |
| 4,798,313 | A | | 1/1989 | Farley |
| 4,832,230 | A | | 5/1989 | Janowitz |
| 5,066,528 | A | | 11/1991 | Krishnakumar et al. |
| 5,156,299 | A | | 10/1992 | De Caluwe et al. |
| 5,203,383 | A | | 4/1993 | Turunen |
| 5,230,446 | A | | 7/1993 | Vaida |
| 5,249,715 | A | | 10/1993 | Tobler |
| 5,263,769 | A | | 11/1993 | Pharr et al. |
| 5,265,769 | A | | 11/1993 | Wilson |
| 5,275,338 | A | | 1/1994 | Tobler |
| 5,301,845 | A | | 4/1994 | Labonte |
| 5,439,141 | A | | 8/1995 | Clark et al. |
| 5,503,274 | A | | 4/1996 | Toffler et al. |
| 5,586,695 | A | * | 12/1996 | Labus et al. ..... 222/396 |
| 5,599,496 | A | | 2/1997 | Krishnakumar et al. |
| 5,603,436 | A | | 2/1997 | Leoncavallo et al. |

(Continued)

*Primary Examiner*—Frederick C. Nicolas
(74) *Attorney, Agent, or Firm*—Jenkens & Gilchrist, P.C.

(57) ABSTRACT

A refillable container adapted to facilitate the purchase and use of larger volumes of consumer products and the selective discharge thereof The refillable container includes a refill-discharge cap assembly allowing ease in filling the container while permitting the selective discharge of lesser quantities of substance therefrom. In one embodiment, a refill-discharge cap is threadably connected to a container body portion wherein the refill-discharge cap includes a relatively small orifice for the selective discharge of the contents of the container therefrom.

34 Claims, 9 Drawing Sheets

U.S. PATENT DOCUMENTS 5,651,471 A 7/1997 Green
5,664,704 A 9/1997 Meadows et al.
5,673,807 A * 10/1997 Valyi ..... 215/232
5,725,114 A * 3/1998 Pickman ..... 215/204
5,829,648 A 11/1998 Goeren et al.
5,853,829 A 12/1998 Krishnakumar et al.
5,868,288 A 2/1999 Redmond, Sr. et al.
5,884,816 A 3/1999 Hinze
5,893,489 A 4/1999 Giarrante
5,927,353 A 7/1999 Perrson et al.
5,944,207 A 8/1999 Reidenbach
5,944,223 A 8/1999 Klima et al.
5,960,998 A 10/1999 Brown
5,992,698 A 11/1999 Copeland et al.
6,015,064 A 1/2000 Liu
6,039,213 A 3/2000 Sloan et al.
6,092,694 A 7/2000 Sadow
6,106,849 A 8/2000 Malkan et al.
6,109,487 A 8/2000 Hashimoto
6,116,451 A 9/2000 Herrmann et al.
6,213,358 B1 4/2001 Libit et al.
6,223,954 B1 5/2001 Carow
6,250,511 B1 6/2001 Kelly
6,305,577 B1 10/2001 Fillmore et al.
6,308,862 B1 10/2001 Fillmore et al.
6,508,379 B1 1/2003 Van De Pol-Klein Nagelvoort et al.
6,938,805 B1 * 9/2005 Brincat ..... 222/568
2001/0022204 A1 9/2001 Klima, Jr. et al.
2001/0035430 A1 11/2001 Litscher

* cited by examiner

REFILLABLE BOTTLE AND SYSTEM OF REUSE

CROSS-REFERENCE TO RELATED APPLICATIONS

This application is a continuation of prior U.S. application Ser. No. 10/082,623, filed Feb. 22, 2002, now U.S. Pat. No. 6,938,805 which claims the benefit of U.S. Provisional Application No. 60/275,794, filed Mar. 14, 2001.

BACKGROUND OF THE INVENTION

1. Field of the Invention

The present invention relates to refillable bottles and, more particularly, but not by the way of limitation, to a refillable bottle having a first dispensing orifice for discharge of the bottle contents therefrom and a second filling orifice of larger size adapted for a receiving substance within the bottle for the filling thereof prior to discharge through the smaller orifice and system of reuse therewith.

2. History of Related Art

It is common in the bottling industry to provide a single size bottle containing various materials including shampoo, cleaning agents, conditioners and the like for use by consumers. Typically these bottles are adapted for a single filling by the manufacturer and subsequent use and disposal by the consumer. Such bottles are generally sufficiently inexpensive to allow them to be disposed of as garbage after discharge of the contents thereof.

The sale of large quantities of consumer products (such as gallon containers or the like) has prompted a need for bottles that may be refillable. For example, shampoo is often sold in large gallon sizes which are inconvenient for routine for use by the consumer. Such consumers typically purchase smaller bottles of the same or similar shampoo, or empty bottles of a generic type, into which a smaller volume of shampoo can be poured. Unfortunately, small bottles typically have but a single orifice and no other means for facilitating the filling thereof from the larger container. In these circumstances, the consumer is often frustrated by spillage of the liquid from the larger bottle which has a tendency to reduce the marketability and/or ease of use of large, economy-size vessels.

Due to the problems set forth above in refillable bottles for consumer products, various innovations have been developed. For example, U.S. Pat. No. 4,725,464 teaches a refillable polyester beverage bottle. Likewise, U.S. Pat. No. 5,927,353 teaches a funnel for use with reusable plastic containers. As set forth herein, the funnel is constructed to be received within the refillable bottle in such a way as to facilitate ease of the refilling step therewith. Other embodiments may be usable within the prior art and adapted to facilitate the reintroduction of various substances into bottles for the convenience of the user. It may be seen, however, that the efficacy of use of such structures would be maximized if the refillable bottle was constructed with a filling aperture larger than the discharge aperture to therein facilitate ease in use by the consumer. The present invention provides such a method and apparatus for consumable product reuse as set forth below.

SUMMARY OF THE INVENTION

The present invention relates to refillable vessels. More particularly, one aspect of the invention comprises a bottle having a large "refill" orifice including a large cap at one end and a small "discharge" orifice and cap at either the same or the opposite end.

In one aspect, the present invention relates to the utilization of a vessel having at least two means for filling and discharging substance therein and therefrom. The refill orifice may be in one embodiment, at the bottom of the vessel opposite a smaller discharge orifice at the top. In another embodiment, the discharge orifice can be disposed in conjunction with and as part of the refill cap securing the portion of the bottle relative to the refill orifice.

In another aspect, the present invention allows consumers to easily refill bottles, such as round plastic bottles used for spraying, pouring or the like without the need for pumps or funnels. The bottles of the present invention can be filled from a larger sized container that is offered for refillable dispensing from manufacturers. Larger quantities of products and concentrated products are typically being offered more than ever in grocery stores as well as discount distribution centers. By utilizing the container of the present invention, consumers will be able to refill bottles as small as 2 ounces and as large as any size a company may provide. The bottles of the present invention may be provided for discharge by pouring, by spraying, by pumping and/or other means conventionally known in the industry.

BRIEF DESCRIPTION OF THE DRAWINGS

A more complete understanding of the method and apparatus of the present system may be obtained by reference to the following Detailed Description when taken in conjunction with the accompanying Drawings wherein.

DETAILED DESCRIPTION

It has been observed that consumers use large quantities of disposable products that are often sold in small bottles. When the consumer is finished with the product, the small bottles are typically not easily refillable and are thus thrown away. This creates a significant refuse issue from an environmental standpoint. The present invention addresses this problem and environmental impact considerations by providing a special bottle design incorporating a refillable section thereof in accordance with the principles of the present invention. As set forth below, the refillable vessel of the present invention may have a refillable orifice disposed in a region thereof facilitating use by the consumer for refilling while permitting ease and control of discharge of the contents thereof in accordance with normal consumer expectations.

Figure 1:
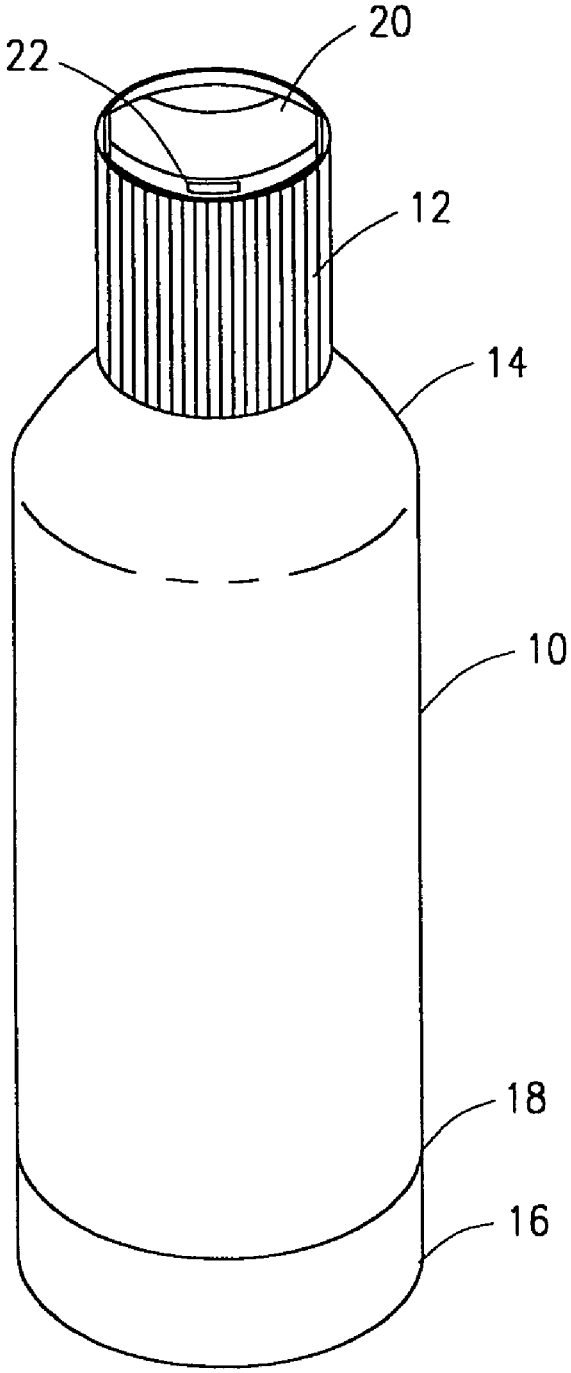
FIG. 1 is a perspective view of one embodiment of a refillable container constructed in accordance with the principles of the present invention.

Referring now to FIG. 1, the present invention pertains to a container 10 adapted for receipt of material such as a liquid therein. The liquid could comprise soap, shampoo, conditioners, or other substances often used by consumers. It should be noted that any of a wide variety of substances could be used and references to specific liquids are not meant in any way to be limiting of the spirit and scope of the present invention.

Still referring to FIG. 1, in this particular embodiment, a discharge assembly or cap 12 is applied to the top 14 of the container while a refill assembly or cap 16 is secured to the bottom end 18 of the container 10. The discharge cap 12 is of smaller diameter than the refill cap 16 whereby the amount of substance discharged from the container 10 during use is more controllable, as is consistent with consumer products today. The difficulty in refilling refillable containers is met by utilizing a larger opening in the bottom end 18 of the container 10 and the use of a larger refill cap 16 secured there across.

Referring still to FIG. 1, the discharge cap 12 may be of the type having a valve mechanism 20 disposed in the top portion thereof including an aperture 22 for discharging substances therefrom, said substances being contained within the container 10. Also, a variety of discharge caps may be used, including spray caps, for the dispensing of liquids such as glass cleaners and hair spray.

Figure 2:
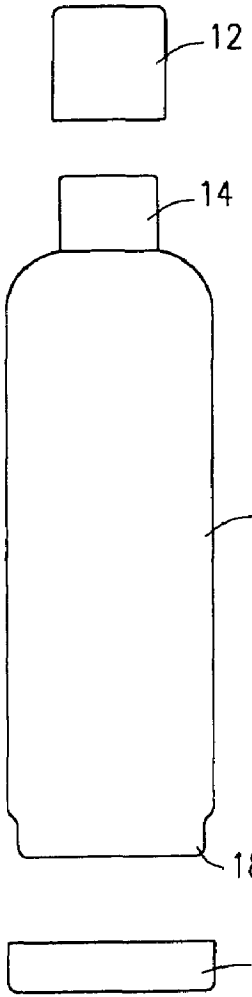
FIG. 2 is a side elevational view of the embodiment of the present invention FIG. 1 illustrating the removal of the top discharge cap, as well as the bottom refill cap.

FIG. 2 is a side elevational view of the container 10 of FIG. 1. It may be seen that the discharge cap 12 is removed from the top 14 of the container 10 while the refill cap 16 is removed from the bottom end 18 of said container. This particular view, with both caps 12 and 16 removed, will facilitate cleaning of the container after use and/or prior to filling.

Figure 3:
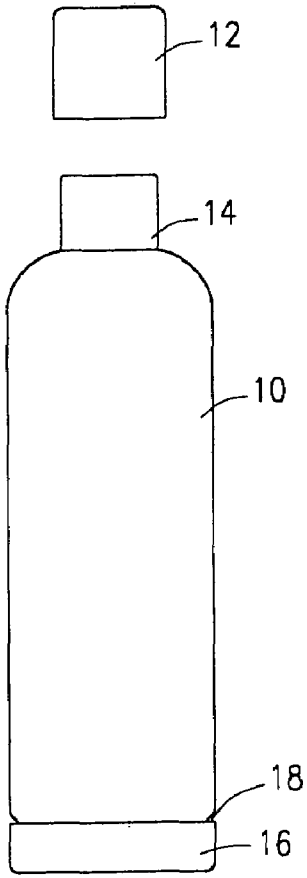
FIG. 3 is a side elevational view of the refillable container of FIG. 2 illustrating the securement of the refill cap and the removal of the discharge cap.

Referring now to FIG. 3, the refill cap 16 has been secured to the bottom end 18 of the container 10 while the discharge cap 12 remains removed from the top 14. It should be noted that the refill region may be formed in other locations in the container.

Figure 4:
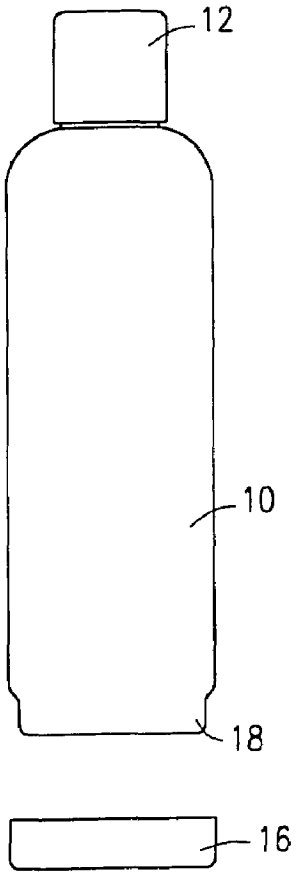
FIG. 4 is a side elevational view of the refillable container of FIG. 2 illustrating the securement of the discharge cap and the removal of the refill cap, for the refilling of the container of the present invention with liquid substance such as shampoo.

FIG. 4 illustrates the container 10 having the discharge cap 12 secured thereto with the refill cap 16 removed from the bottom end 18 thereof In this particular configuration, the container may be inverted to receive the filling of substance therein. The substance can be shampoo or the like as discussed below. The enlarged diameter of the refill portion of the container 10 as afforded by refill cap 16 facilitates the use by consumers of a multitude of consumer products.

Figure 5:
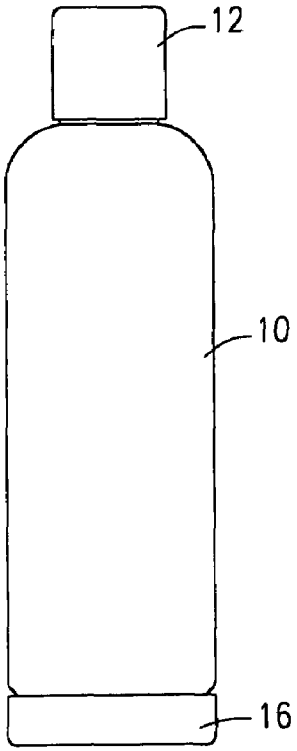
FIG. 5 is a side elevational view of the refillable container of FIG. 2 illustrating the refill cap and the discharge cap secured thereto.

FIG. 5 illustrates the container 10 in its sealed condition with the caps 12 and 16 secured to opposite ends thereof containing the necessary material there within.

Figure 6A:
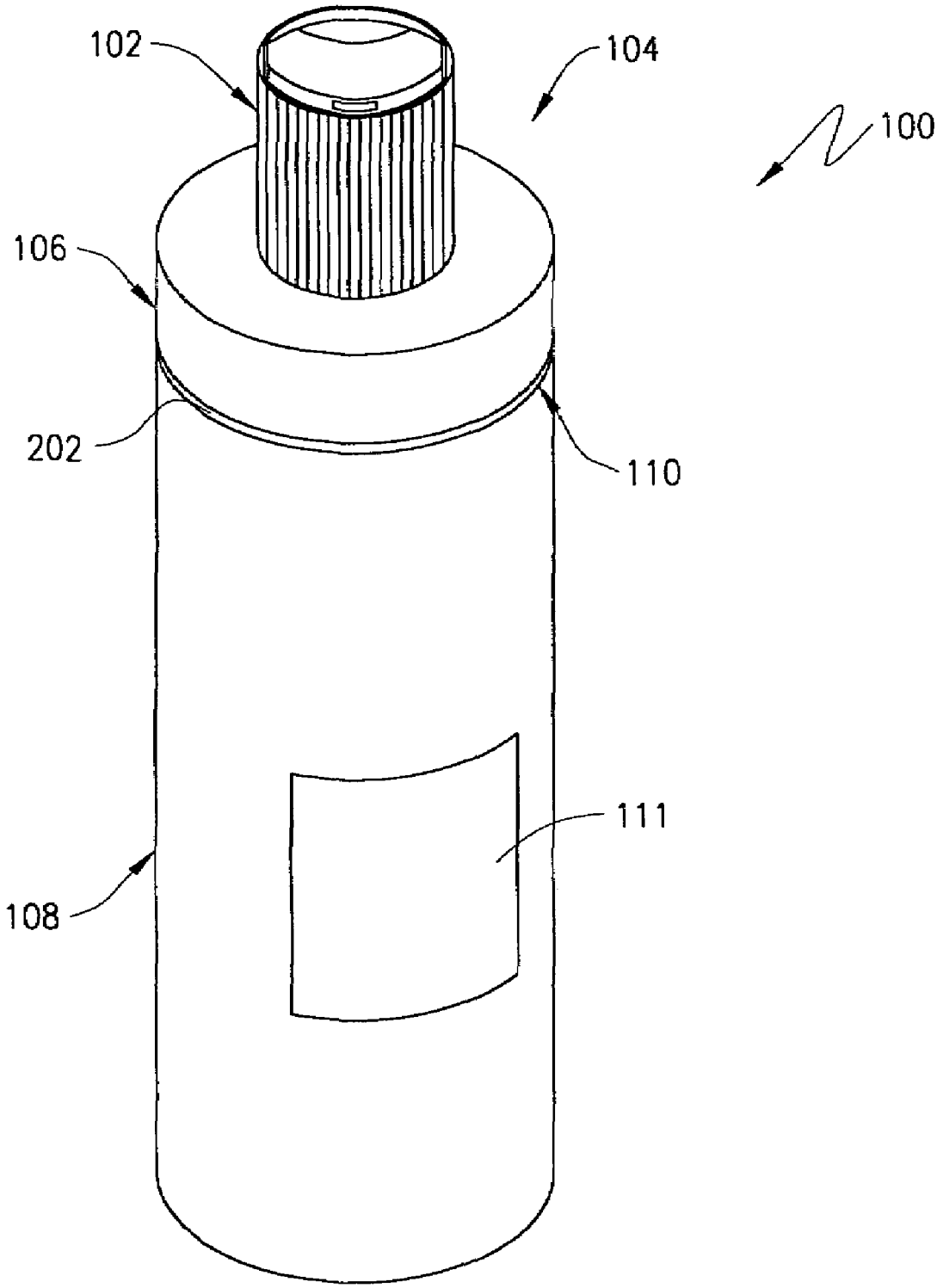
FIGS. 6A and 6B are perspective views of another embodiment of the present invention where the discharge cap and refill cap are both disposed on the same end of the refillable container of the present invention and one aspect of the refill process is illustrated.

Referring now to FIG. 6A, there is shown a perspective view of an alternative embodiment of the present invention. The refillable vessel or container 100 of this embodiment of the present invention includes a discharge cap 102 formed in the upper end 104 of the container 100. Upper end 104 in effect comprises a special refill/discharge cap assembly that connects to a lower body portion 108 of the container 100. Discharge cap 102 may also comprise a portion of an upper body portion 106 that is threadably connected to a lower body portion 108 of the container 100. Whether the upper body portion 106 is considered to comprise a refill/discharge cap assembly or a portion of the container 100, it works the same. As described above, a series of threads 110 facilitate the attachment and detachment of the upper body portion 106 (or refill/discharge cap assembly) relative to lower body portion 108 and defines a refill orifice 202. In this manner, the desired fluid can be easily poured into the lower body portion 108 and discharged through the discharge cap 102, forming part of the upper body portion 106. Reference to upper body portion 106 will be used herein, but it is again reiterated that upper body portion 106 may also be referred to as a discharge/refill cap assembly, because it effectively performs that function and the nomenclature thereof should not be, in any way, limiting to the spirit and scope of the present invention. It may also be noted that other coupling and attachment techniques other than the engagement of threads 110 may be utilized in accordance with the principles of the present invention. Likewise other locations of the discharge cap and refill cap may be provided in accordance with the principles of the present invention. A label 111 is also shown to permit the consumer to apply indicia thereon to identify the contents thereof If the container 100 is formed of clear plastic, the contents are inherently identifiable. Various known materials may be used for the label 111 including indicia applied to or imprinted on the container 100.

Figure 6B:
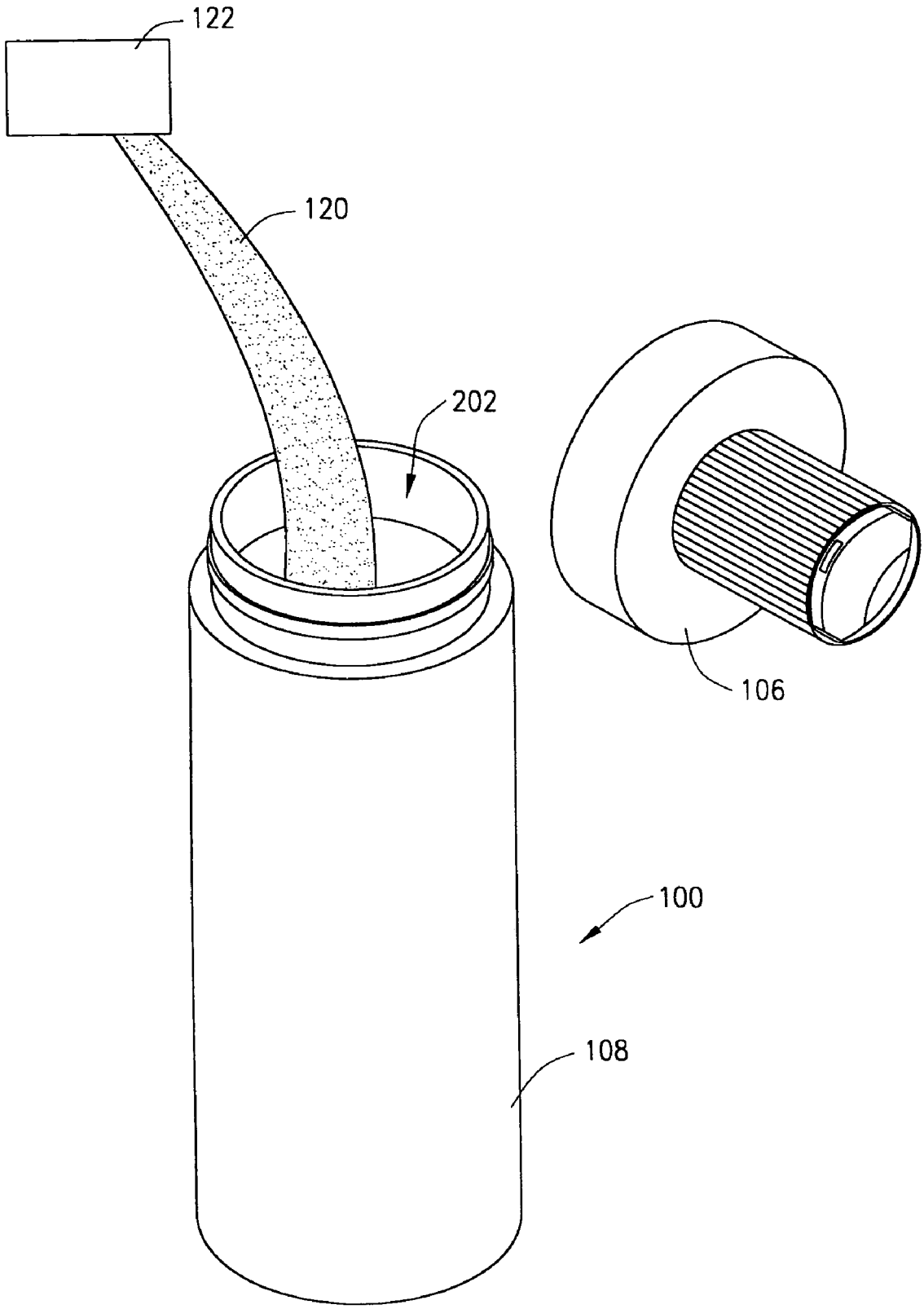

Referring now to FIG. 6B, there is shown the container 100 being filled with a liquid 120. The upper body portion 106 has been removed from lower body portion 108 to permit pouring from a supply 122. As referenced herein, supply 122 may be of a variety of chemical or solution types including large volume quantities of consumer products. Many of these will be outlined below.

Figure 7:
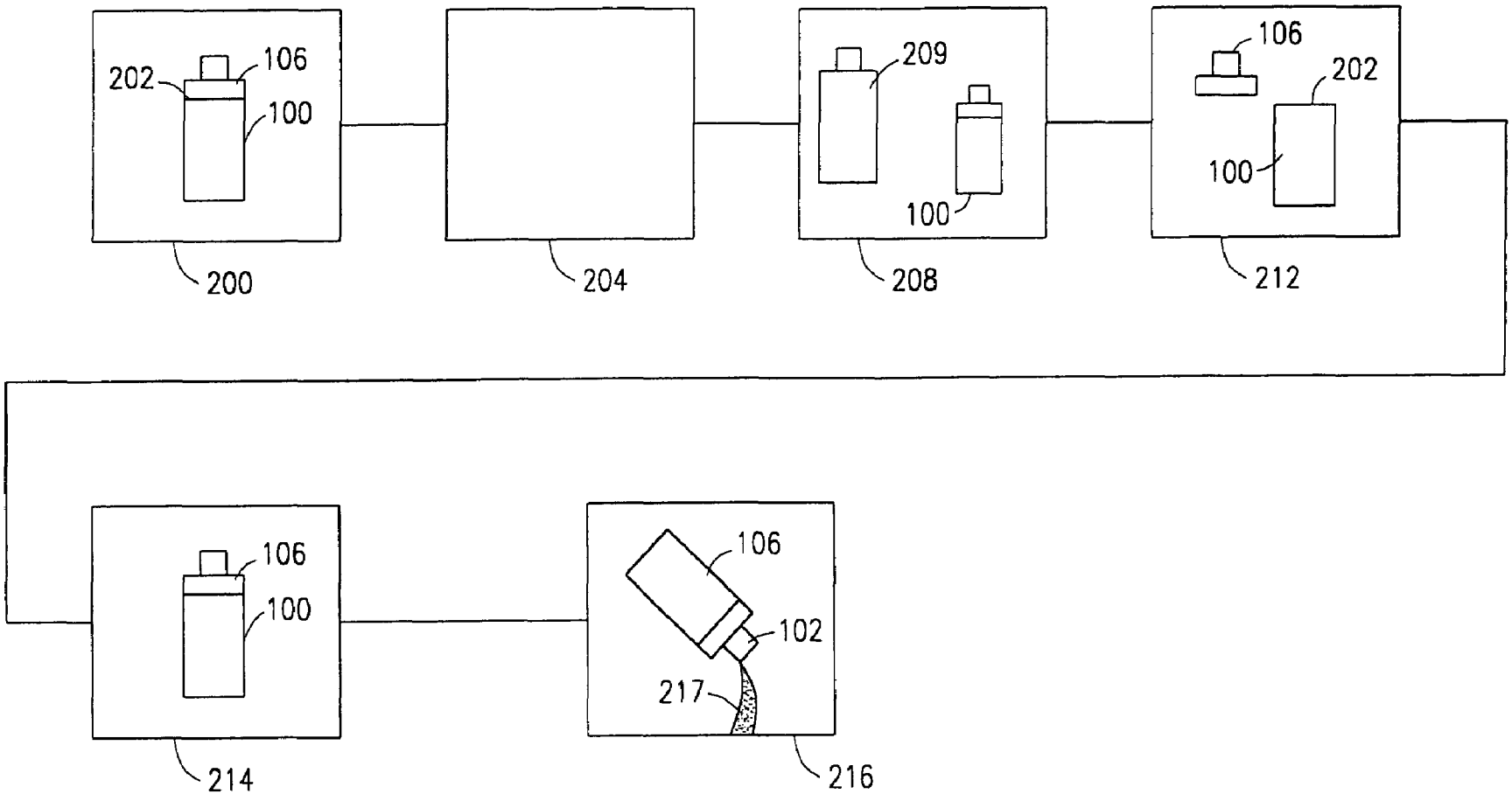
FIG. 7 is a diagrammatic schematic of a method of reusing the specially designed refillable container of the type shown in FIG. 6 according to the principles of the present invention.

FIG. 7 illustrates the diagrammatic schematic of a use of the present invention by consumers and the like. The refillable container 100 is first formed in step 200 with a refill orifice 202 with a discharge orifice formed therein as set forth above. The refillable container 100 is next distributed to consumers in step 204 through refill outlets, direct sale or other conventional marketing techniques. It should be recognized that the manner of marketing and distribution to consumers may vary and does not limit the scope of the present invention. Step 208 illustrates the purchase of a refillable container 100 by a consumer and the purchase of a large volume of material represented by vessel 209 to put in said container. The large volume of material may be shampoo and/or other material as set forth above. Step 212 illustrates the removal of upper body portion 106 of the refillable container 100 and the pouring in of the material for dispensing therefrom. Step 214 illustrates the securement of the upper body portion 106 comprising the refillable/discharge cap, to container 100 with the material contained therein. Step 216 illustrates the discharge of the contents of the refillable vessel of the present invention (in this embodiment, a spray 217)through smaller discharge cap 102 therein. The steps 200 through 216 of the present invention thus illustrate a process by which a single large vessel of material such as a large container of shampoo, may be utilized to supply a consumer with a large quantity of material, such as shampoo, without causing the environmental impact of the discarded multiple smaller containers.

The above described embodiments of the invention and the aspects thereof are deemed to be enabling of a man skilled in the art to manufacture and produce such the refillable container of the present invention. The following specificity is, however, provided by the inventor to further illustrate various aspects of the present invention and to provide more specificity relative to the materials from which the present invention may be fabricated and by which the present invention may improve a consumer's ability to purchase larger quantities of products in conjunction with the principles of the present invention.

The new innovative designs allow a consumer to easily refill all round plastic containers, or plastic spray containers without the use of pumps or funnels. The refillable container of the present invention can be refilled from larger sized containers that are offered for refillable dispensing from manufacturers. Larger quantities of products and concentrates are being offered more than ever in grocery stores and stores like Costco, Smart and Final, and others. Consumers will be able to refill containers as small as 2 oz. and as large as any size a company may provide. The spray containers also can be designed to meet any company's request. The new designs are an environmental lifestyle product, that can be made from recycled plastics, H.D.P.E., P.E.T., L.D.P.E., P.P., and P.V.C. plastics. The refillable containers of the present invention are reusable. They will reduce waste, landfills, air pollution, and water. They will save energy by reducing the number of bottles being manufactured.

Manufacturers, consumers and the planet will benefit from this new innovative design of plastic containers and plastic spray containers. Corporations and manufacturers have a responsibility for the environment. When offered refillable containers, consumers can refill their favorite products, like shampoos, conditioners and other hair care products, auto care products, household cleaning agents, as well as any other liquid products a consumer may use. Compromising the quality of life for future generations can be prevented if we begin to do what is best for our planet.

Exemplary Bottles Materials, Shapes and Sizes

Shapes:
1. Boston Round/Bullet
2. Cylinder
3. Oval
4. Colossal/Commercial
5. Rectangular Materials:
1. PET—Polyethylene Terephthalate
2. HDPE—High Density Polyethylene
3. LDPE—Low Density Polyethylene
4. PP—Polypropylene
5. PVT—Polyvinyl Chloride Sizes:
1. Boston Round/Cylinder/Oval 2 oz. 4 oz., 6 oz., 8 oz., 12 oz., 16 oz., 32 oz./or any size a company may request
2. Colossal/Rectangular commercial spray bottles 12 oz., 16 oz., 22 oz., 24 oz., 32 oz./or any size a company may request

Exemplary Caps and Cap Designs

Tops:
Flip Tops—Flips open
Poly Tops—Spout flips open, folds up and down
Disc/Press Caps—Press down to pop up spout
Spouts/With red or colored tip
Misters and Sprays
Pumps/Trigger Sprayers
Dropper Tips and Caps
Push and Pull Caps
Pumps Dispenser for lotions Cap Sizes:
18/410, 20/410, 24/410, 28/410

Flip Tops
Poly Tops—Misters and Sprayers
Disc/Press Caps—Pumps
Push and Pull Caps
20/410, 20/415, 24/410, 28/410, 38/400, 28/400, 28/410
Cap Sizes for Spray Bottles/Misters
15/415, 28/400, 24/410
Plastic Dropper Tips and Caps
Note: All caps can be smooth and ribbed

Alternative Embodiments of Use

Filling:

Bottles are refilled by unscrewing the top of the bottle or sprayer, just under the cap or sprayer. The cap or sprayer itself, does not have to be unscrewed.

By unscrewing the larger portion of the bottle or sprayer, a consumer can easily refill any size bottle or sprayer without the use of funnels or pumps.

When the bottle or sprayer has been filled, the consumers can easily screw on the top portion of the bottle for a secure, tight fit.

Discharging:

Products can be discharged from the following types of caps:
1. Flip Tops (flip Open)
2. Polly tops (Spout lips open, and folds up and down)
3. Disc/Press Caps (press down to pop up spout)
4. Spout Tips
5. Push and Pull Caps Product is discharged from all caps listed above by squeezing the plastic bottle.

Product is discharged from trigger sprayers, mister sprayers and all other sprayers by squeezing the handle of the sprayer.

Discharging Products from Pumps:

Product is discharged from pumps by pushing the pump down, making the liquid product to come out of the spout on the pump.

Product is discharged from a spout by removing the top cap from the plastic bottle, and then squeezing the plastic bottle.

Listing of Various Substances for Use With the Refillable Container of the Present Invention 1. Hair Care Products (shampoos, conditioners, hair sprays, hair gels, hair lotions, etc.)
2. Body Care Products (body oils, body lotions, liquid body soap).
3. Skin Care Products (moisturizers, makeup remover, facial treatments, toners)
4. Sun Care Products (sun screens, self tanning lotions)
5. Contact Lens Solutions (drops, Saline solutions)
6. Cleaning Products (window cleaners, bleaches, tile cleaners, ammonia, bathroom/kitchen cleaners, stain removers, dishwater soap, liquid laundry detergent, dishwater detergent etc.)
7. Health Care Products (antiseptics, etc.)

8. Beauty Products (nail polish remover, bubble baths, liquid makeup, after shave lotions, perfumes)
9. Automobile supplies (all car interior Protectants, upholstery cleaners, window cleaners, car wash concentrate, protectants)
10. Personal Hygiene Products (mouthwash)
11. Food Supplies (ketchup bottles, mustard bottles, Worcestershire sauces, vinegar, oils, etc.)
12. Beverages (water bottles, juice bottles, alcohol bottles)

Household Cleaning Agents that May be Used With the Refillable Container of the Present Invention Vegetable and Fruit Wash
Liquid Bathroom Cleaner
Dishwater Liquid Soap
Window Cleaners
Household Cleaner
Ammonia
Bleach
Dishwater Liquid Detergent
Liquid Soaps
Liquid Stain Removers
Spray Cleaners
Any Liquid Household Cleaning Products Automobile Supplies Which May Be Used With the Refillable Container of the Present Invention Bug and tar remover
Liquid Carwax Car Polishes, Auto Care Protectants, and Deodorizers
Convertible top cleaners, plastic plexiglass cleaners
Tire wet gel, professional protectant (vinyl, rubber, plastic) tire wet
Wheel cleaners, mag cleaners, aluminum cleaners, polishes, waxes, auto glass cleaners
Bleach white sprays
Liquid cleaner degreasers Types of Blow-Molding Processes for the Manufacturer of a Refillable Container in Accordance With the Principles of the Present Invention There are two basic blow molding processes: injection blow molding and extrusion blow molding. The injection blow molding process is similar to injection molding and is limited to smaller sizes of parts than extrusion blow molding. The injection blow molding process produces parts to tight dimensional or weight tolerances that might not be achievable with the extrusion blow molding process. These tight tolerances may be required for some automatic filling applications. Injection blow molding is also used to mold parts out of materials such as PET or polystyrene (PS) which are difficult to mold by the extrusion blow molding process. Injection blow molded parts can be produced without flash or trimming. Some materials produce clearer bottles when injection blow molded. Although tooling is more expensive for injection blow molding, the cycles times are faster than for extrusion blow molding.

Injection Blow Molding:

For injection blow molding, the plastic is melted in an injection molder style extruder and is injected into a steel mold under high pressure to create a pre-form. A core rod forms the interior dimensions of the pre-form while the steal mold forms the outside dimensions. When the pre-form has cooled sufficiently, the mold opens vertically and the pre-form on the core rod is lifted and rotated to the blow mold. The blow mold, which is usually aluminum, closes on the core rod and pre-form, air is blown through the core rod, and the final shape of the part is formed. Thus, the injection molded details can be obtained on a hollow part which could not otherwise be injection molded. Sometimes a fourth station is used on an injection blow molder for printing or orientation.

Blow Molding:

During the initial stage of this process, the injection stage, the melt is injected into a split parison cavity and around a predetermined core rod. Once the melt is conditioned, the molds open and then rotate 120 degrees to transfer the parison into a split blow mold cavity (blow mold station). Compressed air enters through the core rod, blowing the conditioned parison melt against the blow mold cavity wall. After the material has cooled in the blow mold cavity, the molds open and the finished container is then rotated 120 degrees for transfer to the pick off (eject) station for removal from the core rod.

In the pick off station, bottles are automatically removed from the core rods and fall directly into a shipping carton or are placed in an upright position on a conveyer belt for posthandling.

| BOTTLE SIZE | BLOW-MOLDED | INJECTION MOLDED |
|---|---|---|
| 2 ounce bottle | X | |
| 4 ounce bottle | X | |
| 8 ounce bottle | X | |
| Spray bottle | X | |
| 2 ounce bottle cap | | X |
| 4 ounce bottle cap | | X |
| 8 ounce bottle cap | | X |
| Spray bottle cap | | X |

All size bottles are Blow Molded
All size caps are Injection Molded

Figure 8A:
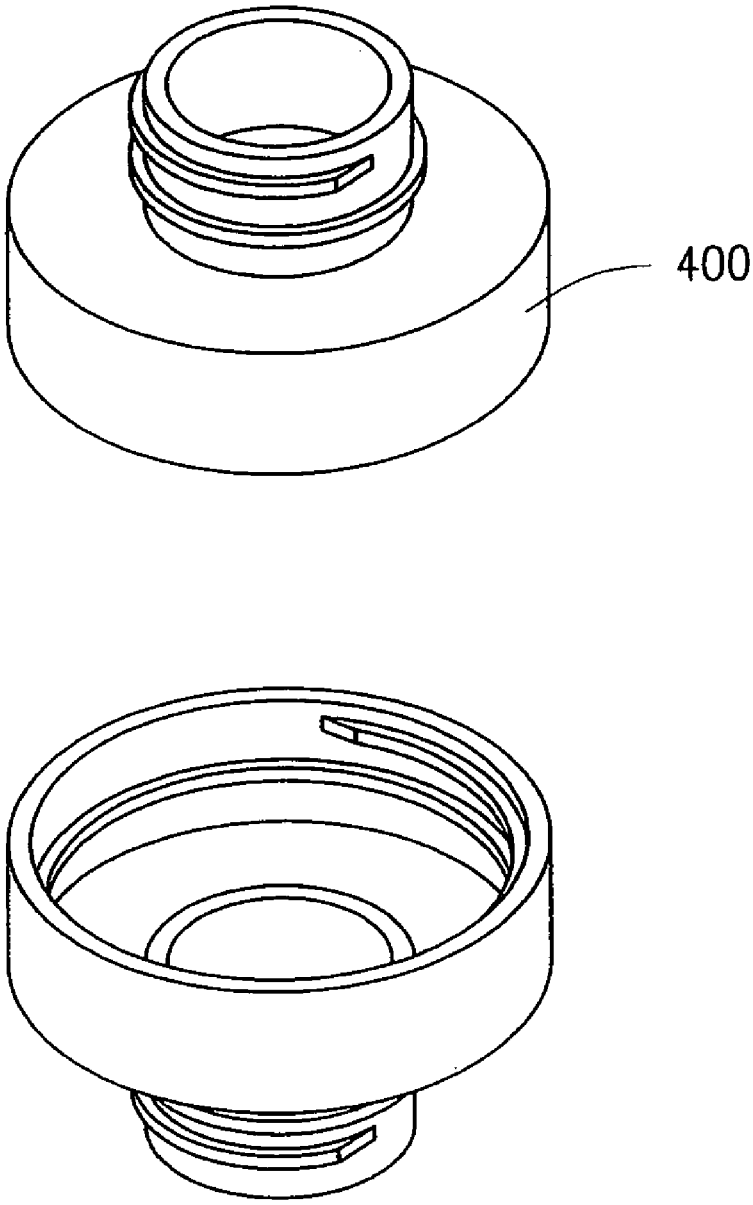
FIGS. 8A through 8D illustrate views of alternative embodiments of the refillable container and parts thereof in accordance with the principles of the present invention.

Referring now to FIG. 8A, there is shown a top 400 constructed in accordance with the principles of the present invention. In this particular embodiment, the inventor suggests the fabrication by injection molding and use of the top 400 for spray bottles and the like. It is suggested that this particular top is useful with household cleaning products, industrial products, auto care products, and the like. Styles would include clear, PVC, spray bottles and the following:

spray bottles, waxes, starches, cleaners, disinfectants, air fresheners, deodorants, insecticides, and more. Spraymaster, has clear strip for view level, chemical resistant spray bottles with or without O-rings. Commercial sprayer, safety ID for types of contents high volume sprayers, for heavy jobs, handi hold spray bottles Sizes:

12 oz., 16 oz., 22 oz., 24 oz., 32 oz., 36 oz., or any size a company may request.

Materials:

Clear P.V.C. Polyvinyl Chloride
H.D.P.E. High Density Polyethylene
L.D.P.E. Low Density Polyethylene
P.P. Polypropylene
P.E.T. Polyethylene Terephthalate.

Figure 8B:
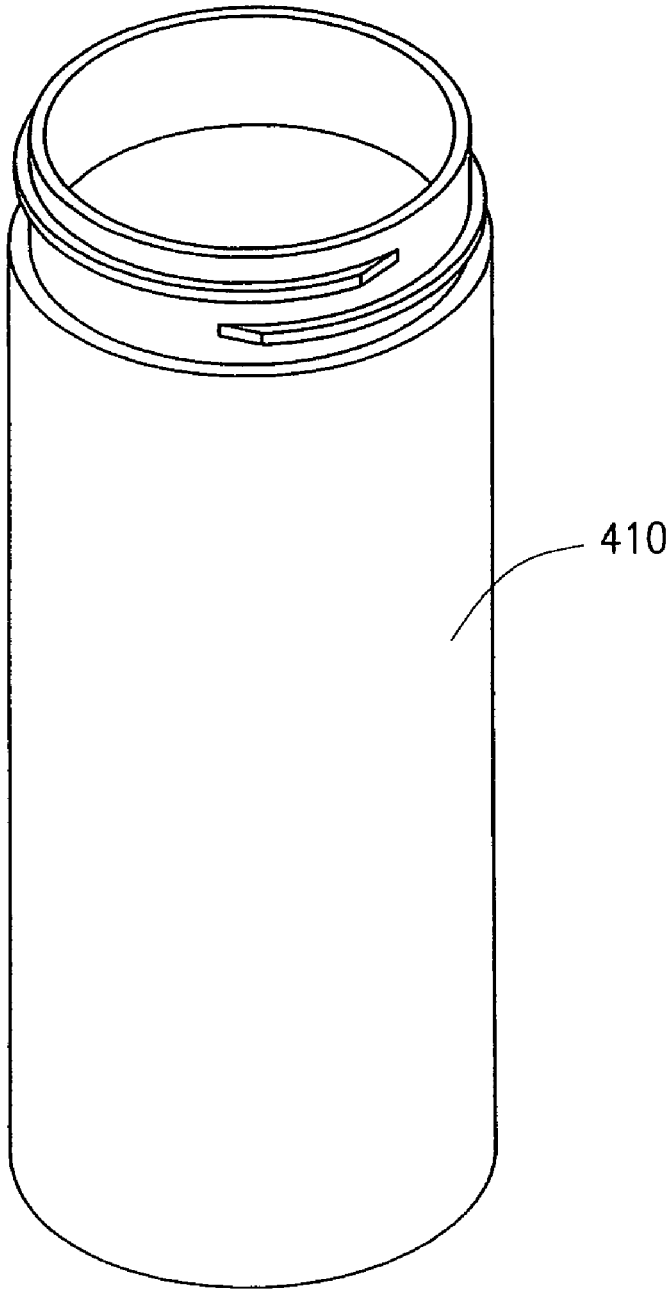

Referring to FIG. 8B, there is shown a bottom portion 410 of a refillable container constructed in accordance with the principles of the present invention that may be fabricated by blow molding or the like. In this particular embodiment, the inventor suggests that the construction would be particularly adapted for personal care and liquid products with the following specific manufacturing aspects.

Styles and shapes:
Boston Round, Cylinder Round, Royalty, Imperial Rounds, Custom Molding, Modified-Cylinder Round, Tear Drop Sizes:
2 oz., 3 oz., 4 oz., 5 oz., 6 oz., 8 oz., 10 oz., 12 oz., 14 oz., 16 oz., 32 oz., ½ oz., 1 gallon Materials:
Clear P.V.C. Polyvinyl Chloride
H.D.P.E. High Density Polyethylene
L.D.P.E. Low Density Polyethylene
P.P. Polypropylene
P.E.T. Polyethylene Terephthalate.

Still referring to FIG. 8B, the additional following information is also provided by the inventor relative to the utilization of the bottom portion 410 fabricated by blow molding wherein household cleaning products, industrial products and auto care products may be utilized therewith.

Styles:
Clear P.V.C. spray bottles
Spray bottles, waxes, starches, cleaners, disinfectants, air fresheners, deodorants, insecticides, and more
Spraymaster, has clear strip for view level
Chemical resistant spray bottles
Commercial sprayer, safety I.D. for type of contents
High volume sprayers, for heavy jobs
Handi hold spray bottles Sizes:
12 oz., 16 oz., 22 oz., 24 oz., 32 oz., 36 oz., or any size a company may request.

Materials:
Clear P.V.C. Polyvinyl Chloride
H.D.P.E. High Density Polyethylene
L.D.P.E. Low Density Polyethylene
P.P. Polypropylene
P.E.T. Polyethylene Terephthalate.

Figure 8C:
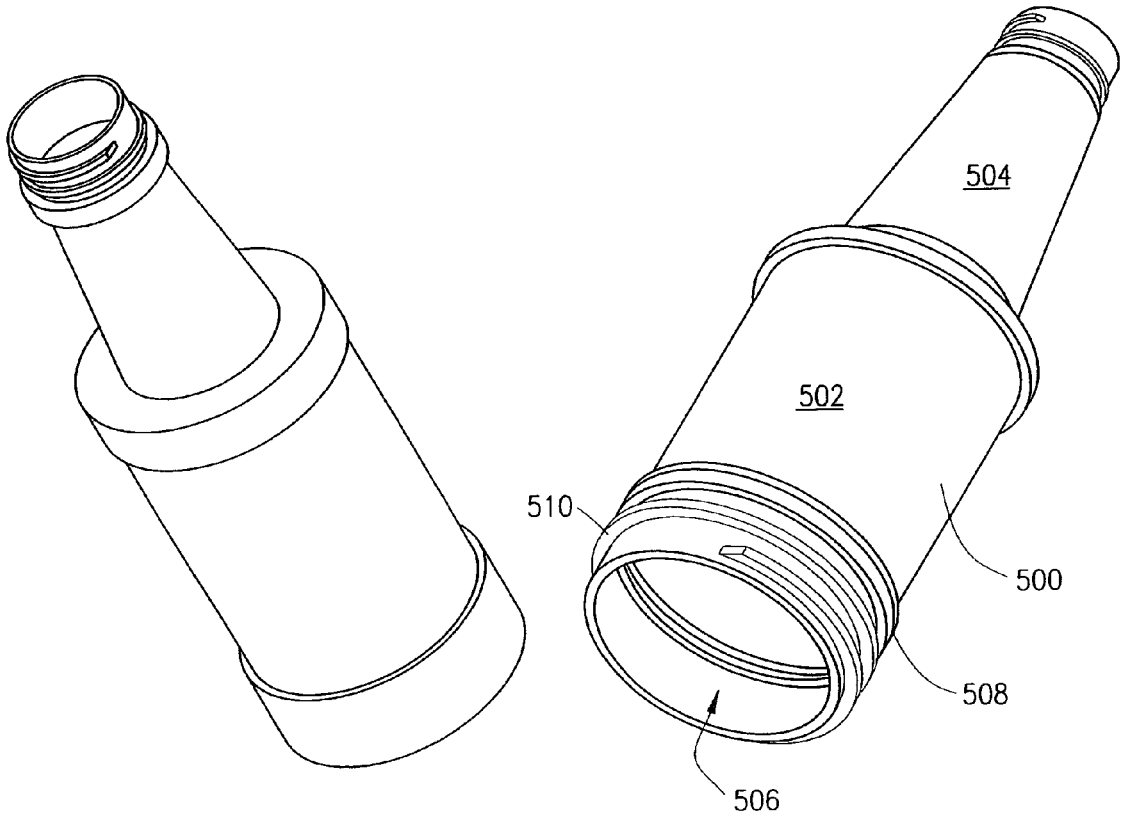

Referring now to FIG. 8C, there is shown an alternative embodiment of the construction of a refillable container according to the principles of the present invention. The container 500 has an enlarged lower body portion 502 and a reduced neck portion 504. It may be seen with a refillable orifice 506 is disposed at the bottom end 508 thereof. Threads 510 are provided for receipt of a suitably sized threaded bottom cap for use therewith.

Figure 8D:
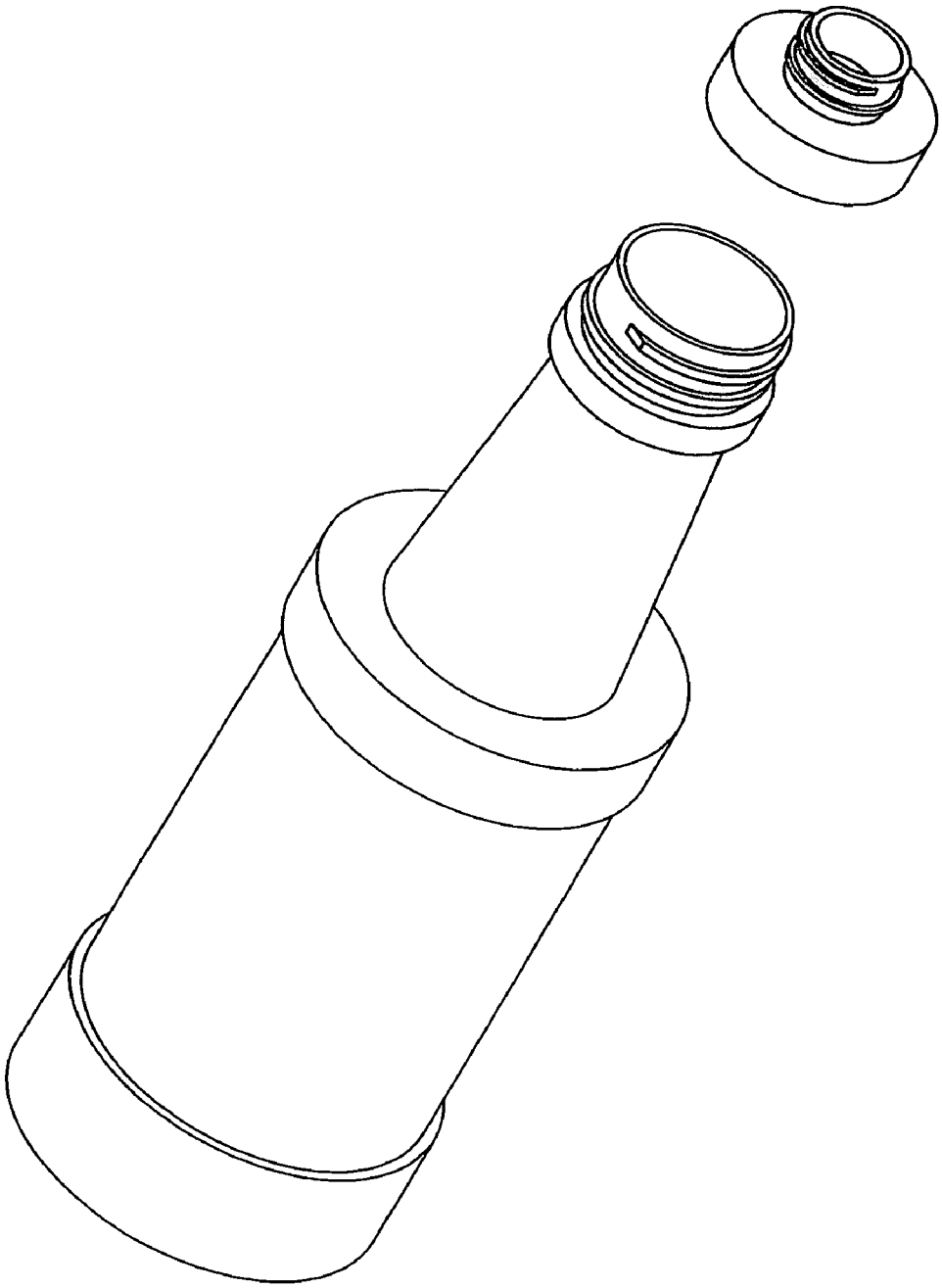

FIG. 8D illustrates yet another embodiment of the refillable container in the present invention and a cap for use therewith.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

I claim:

1. A refillable container for select discharge and refilling by a user of a substance, the refillable container comprising:

an elongate generally cylindrical lower body portion having a first outside diameter and being adapted for containing the substance therein for use therewith, the elongate generally cylindrical lower body portion having a solid bottom portion, an open threaded top adapted for poured receipt of the substance, and a generally cylindrical sidewall for holding the substance directly thereagainst;

a generally cylindrical upper body portion having a second outer diameter substantially equivalent to the first outside diameter, and a generally planar top surface, and being adapted for threadable engagement with and flush abutting engagement to the elongate generally cylindrical lower body portion such that the generally cylindrical upper body portion comprises a generally flush cylindrical extension of the elongate generally cylindrical lower body portion when the generally cylindrical upper body portion is threadably engaged to the elongate generally cylindrical lower body portion thereby defining therebetween a substantially uniform cylindrical outer surface thereacross to facilitate handling thereof by the user, the generally cylindrical upper body portion being further adapted for disengagement from the elongate generally cylindrical lower body portion to facilitate pouring of the substance into the elongate generally cylindrical lower body portion by the user; and the generally cylindrical upper body portion further comprising a discharge cap threadably mounted to the substantially planar top surface of the generally cylindrical upper body portion to cause the discharge cap to upstand from the substantially planar top surface of the generally cylindrical upper body portion in substantially direct contact therewith, the discharge cap having a discharge orifice of a diameter substantially smaller than the outside diameter of the elongate generally cylindrical lower body portion, the discharge cap adapted for select discharge by the user of the substance from the refillable container.

2. The refillable container of claim 1, wherein the discharge cap is formed with threads along an inner surface thereof.

3. The refillable container of claim 1, wherein the open threaded top of the elongate generally cylindrical lower body portion is formed with threads along an outer surface thereof.

4. The refillable container of claim 1, wherein the generally cylindrical upper body portion is formed with threads along an inner surface thereof.

5. The refillable container of claim 1, wherein the user is a consumer.

6. The refillable container of claim 1, wherein the substance comprises a liquid.

7. The refillable container of claim 1, wherein the discharge cap comprises a spray device adapted for the discharge of the substance from the refillable container in a spray form.

8. The refillable container of claim 1, wherein the discharge cap includes a discharge mechanism adapted for discharge of selective amounts of the substance therefrom.

9. The refillable container of claim 1, wherein the generally cylindrical lower body portion further includes means for identify the contents of the refillable container.

10. The refillable container of claim 9, wherein the means for identifying comprises a label.

11. The refillable container of claim 1, wherein the discharge cap comprises a pump unit adapted for pumping the contents of the refillable container outwardly therefrom by a pumping operation thereof.

12. The refillable container of claim 1, wherein the discharge cap is generally cylindrical in shape.

13. The refillable container of claim 1, wherein the refillable container is flexible in construction whereby the substance contained therein may be squeezed by the user to facilitate the discharge thereof.

14. The refillable container of claim 1, wherein the refillable container is formed of a plastic material.

15. The refillable container of claim 1, wherein at least a portion of the refillable container is formed of a substantially transparent material.

16. The refillable container of claim 1, wherein at least a portion of the refillable container is formed using a blow-molding process.

17. The refillable container of claim 1, wherein at least a portion of the refillable container is formed using an injection-molding process.

18. A refillable container for select discharge and refilling by a user of a substance, the refillable container comprising:

an elongate generally cylindrical lower body portion having a first outside diameter and being adapted for containing the substance therein for use therewith, the elongate generally cylindrical lower body portion having a solid bottom portion, an open threaded top adapted for poured receipt of the substance, and a generally cylindrical sidewall for holding the substance directly thereagainst; and a discharge/refill assembly comprising:

a generally cylindrical upper body portion having a second outer diameter substantially equivalent to the first outside diameter, and a generally planar top surface, and being adapted for threadable engagement with and flush abutting engagement to the elongate generally cylindrical lower body portion such that the generally cylindrical upper body portion comprises a generally flush cylindrical extension of the elongate generally cylindrical lower body portion when the generally cylindrical upper body portion is threadably engaged to the elongate generally cylindrical lower body portion thereby defining therebetween a substantially uniform cylindrical outer surface thereacross to facilitate handling thereof by the user, the generally cylindrical upper body portion being further adapted for disengagement from the elongate generally cylindrical lower body portion to facilitate pouring of the substance into the elongate generally cylindrical lower body portion by the user; and a discharge cap threadably mounted to the substantially planar top surface of the generally cylindrical upper body portion to cause the discharge cap to upstand from the substantially planar top surface of the generally cylindrical upper body portion in substantially direct contact therewith, the discharge cap having a discharge orifice of a diameter substantially smaller than the outside diameter of the elongate generally cylindrical lower body portion, the discharge cap adapted for select discharge by the user of the substance from the refillable container.

19. The refillable container of claim 18, wherein the discharge cap is formed with threads along an inner surface thereof.

20. The refillable container of claim 18, wherein the open threaded top of the elongate generally cylindrical lower body portion is formed with threads along an outer surface thereof.

21. The refillable container of claim 18, wherein the generally cylindrical upper body portion is formed with threads along an inner surface thereof.

22. The refillable container of claim 18, wherein the user is a consumer.

23. The refillable container of claim 18, wherein the substance comprises a liquid.

24. The refillable container of claim 18, wherein the discharge cap comprises a spray device adapted for the discharge of the substance from the refillable container in a spray form.

25. The refillable container of claim 18, wherein the discharge cap includes a discharge mechanism adapted for discharge of selective amounts of the substance therefrom.

26. The refillable container of claim 18, wherein the generally cylindrical lower body portion further includes means for identify the contents of the refillable container.

27. The refillable container of claim 26, wherein the means for identifying comprises a label.

28. The refillable container of claim 18, wherein the discharge cap comprises a pump unit adapted for pumping the contents of the refillable container outwardly therefrom by a pumping operation thereof.

29. The refillable container of claim 18, wherein the discharge cap is generally cylindrical in shape.

30. The refillable container of claim 18, wherein the refillable container is flexible in construction whereby the substance contained therein may be squeezed by the user to facilitate the discharge thereof.

31. The refillable container of claim 18, wherein the refillable container is formed of a plastic material.

32. The refillable container of claim 18, wherein at least a portion of the refillable container is formed of a substantially transparent material.

33. The refillable container of claim 18, wherein at least a portion of the refillable container is formed using a blow-molding process.

34. The refillable container of claim 18, wherein at least a portion of the refillable container is formed using an injection-molding process.

* * * * *

UNITED STATES PATENT AND TRADEMARK OFFICE

CERTIFICATE OF CORRECTION

PATENT NO. : 7,051,907 B2
APPLICATION NO. : 11/174066
DATED : May 30, 2006
INVENTOR(S) : Kenneth Brincat It is certified that error appears in the above-identified patent and that said Letters Patent is hereby corrected as shown below:

| | |
|---|---|
| On Title Page, Item (76)<br>Inventor Section | Replace "Kennth Brincat"<br>With --Kenneth Brincat-- |
| On Title Page, Item (57)<br>Abstract, line 3 | Replace "thereof The"<br>With --Thereof. The-- |
| Column 3, line 50 | Replace "thereof In"<br>With --thereof. In-- |
| Column 4, line 24 | Replace "thereof If"<br>With --thereof. If-- |
| Column 9, line 12 | Replace "1/2 oz.,"<br>With --1/2 gallon,-- |

Signed and Sealed this

Tenth Day of April, 2007

JON W. DUDAS
*Director of the United States Patent and Trademark Office*